US006868902B1

(12) United States Patent
Roodenburg et al.

(10) Patent No.: US 6,868,902 B1
(45) Date of Patent: Mar. 22, 2005

(54) MULTIPURPOSE REELED TUBING ASSEMBLY

(75) Inventors: Joop Roodenburg, Delft (NL); Pieter Dirk Melis Van Duivendijk, Utrecht (NL)

(73) Assignee: ITREC B.V., Schiedam (NL)

( * ) Notice: Subject to any disclaimer, the term of this patent is extended or adjusted under 35 U.S.C. 154(b) by 25 days.

(21) Appl. No.: 10/341,923

(22) Filed: Jan. 13, 2003

Related U.S. Application Data

(60) Provisional application No. 60/348,752, filed on Jan. 14, 2002.

(51) Int. Cl.[7] ..... E21B 19/22; E21B 19/00

(52) U.S. Cl. ..... 166/77.2; 166/75.14; 166/346; 166/384

(58) Field of Search ..... 166/378, 380, 166/381, 384, 75.11, 77.1, 77.2, 77.4, 77.51, 85.1, 75.14, 343, 346

(56) References Cited

U.S. PATENT DOCUMENTS

| | | | | | |
|---|---|---|---|---|---|
| 3,116,793 | A | * | 1/1964 | McStravick | 166/285 |
| 3,658,298 | A | | 4/1972 | Moore | 254/190 |
| 3,714,995 | A | | 2/1973 | Hanes | 175/5 |
| 3,791,628 | A | | 2/1974 | Burns | 254/172 |
| 3,804,183 | A | | 4/1974 | Duncan | 175/5 |
| 3,841,407 | A | * | 10/1974 | Bozeman | 166/384 |
| 3,917,230 | A | | 11/1975 | Barron | 254/173 |
| 4,249,600 | A | * | 2/1981 | Bailey | 166/77.2 |
| 4,336,840 | A | * | 6/1982 | Bailey | 166/77.4 |
| 4,423,994 | A | | 1/1984 | Schefers | 414/22 |
| 4,515,220 | A | * | 5/1985 | Sizer et al. | 166/384 |
| 4,570,705 | A | * | 2/1986 | Walling | 166/77.2 |
| 4,612,984 | A | | 9/1986 | Crawford | 166/77 |
| 4,620,692 | A | | 11/1986 | Foreman | 254/277 |
| 4,688,764 | A | | 8/1987 | Nayler | 254/277 |
| 4,702,320 | A | | 10/1987 | Gano et al. | 166/343 |
| 4,730,677 | A | | 3/1988 | Pearce et al. | 166/345 |
| 4,867,418 | A | | 9/1989 | Daniels | 254/277 |
| 5,291,956 | A | * | 3/1994 | Mueller et al. | 175/67 |
| 5,551,803 | A | | 9/1996 | Pallini | 405/223.1 |
| 5,671,811 | A | * | 9/1997 | Head | 166/346 |
| 5,738,173 | A | * | 4/1998 | Burge et al. | 166/385 |
| 5,839,514 | A | * | 11/1998 | Gipson | 166/384 |
| 5,875,850 | A | * | 3/1999 | Burge et al. | 166/385 |
| 5,894,895 | A | | 4/1999 | Welsh | 175/5 |
| 6,009,216 | A | * | 12/1999 | Pruett et al. | 385/12 |
| 6,032,744 | A | * | 3/2000 | Burge et al. | 166/385 |
| 6,065,540 | A | * | 5/2000 | Thomeer et al. | 166/297 |
| 6,116,345 | A | * | 9/2000 | Fontana et al. | 166/343 |
| 6,158,516 | A | * | 12/2000 | Smith et al. | 166/385 |
| 6,273,188 | B1 | * | 8/2001 | McCafferty et al. | 166/77.2 |
| 6,276,454 | B1 | * | 8/2001 | Fontana et al. | 166/343 |
| 6,315,052 | B1 | * | 11/2001 | Sola | 166/384 |

(List continued on next page.)

FOREIGN PATENT DOCUMENTS

| | | | |
|---|---|---|---|
| GB | 2171974 A | 3/1986 | B66C/13/04 |
| WO | PCT NO98/00342 | 11/1998 | E21B/15/00 |

*Primary Examiner*—David Bagnell
*Assistant Examiner*—Jennifer H Gay

(57) ABSTRACT

The invention is a multipurpose system for reeling tubing secured to a platform made of a reel support frame removeably secured to a platform, a reel containing tubing removeably secured to the reel support frame, a reel drive for rotating the reel disposed on the reel support frame, a tower for suspending the straightener and the guide, a support frame attached to the tower, a guide disposed on the support frame for receiving tubing from the reel and ending the tubing forming bent tubing, a straightener disposed on the support frame for receiving the bent tubing and forming straightened tubing, a rotating connection for connecting the support frame to the tower, a tensioner frame removeably mounted on the platform, and a tensioner secured to the tensioner frame for receiving the straightened tubing, supporting the straightened tubing and moving the straightened tubing.

20 Claims, 4 Drawing Sheets

U.S. PATENT DOCUMENTS 6,361,262 B1 * 3/2002 Roodenburg ..... 414/22.51
6,398,457 B2 6/2002 Baugh ..... 405/170
6,431,286 B1 * 8/2002 Andreychuk ..... 166/384
6,454,014 B2 * 9/2002 Coats et al. ..... 166/384
6,502,541 B2 * 1/2003 Abo et al. ..... 123/295
6,554,075 B2 4/2003 Fikes ..... 166/379
6,601,649 B2 8/2003 Beato ..... 166/352
2003/0010505 A1 * 1/2003 Gipson ..... 166/384

* cited by examiner

MULTIPURPOSE REELED TUBING ASSEMBLY

The present application claims priority to Provisional Patent Application Ser. No. 60/348,752 filed in the U.S. Patent and Trademark Office on Jan. 14, 2002.

FIELD OF THE INVENTION

This invention relates to a faster, safer way to run casing pipe or other tubulars, such as into a riser on a drilling rig, which can handle up to two or more running functions simultaneously.

BACKGROUND OF THE INVENTION

This invention relates to method and apparatus for running tubing in a continuous mode in subsea wells whose wellheads are located on or near the ocean floor or wells located on land.

In the maintenance and servicing of subsea wells several systems have been used. Tools have been developed which involve the erection of a riser pipe on the well. Recently flexible pipe and systems have been developed. See U.S. Pat. Nos. 4,702,320 and 4,730,677.

One well-known system for servicing wells on land has involved the use of coiled tubing, which is forced into a well by a tubing injector. This equipment makes possible the injection of fluid and the use of a well tool on the tubing. See U.S. Pat. No. 4,612,984. Tubing injectors have also been used in the same manner on offshore platforms where the wellhead is located on the platform adjacent the surface of the water and the injector is located on the platform.

Each of these prior art systems has its advantages and disadvantages. Both systems prior applications are not used to drill a well. This is an economic disadvantage, drilling systems are very expensive to purchase, operate and maintain. Also the daily running cost of most floating drilling platforms is very high. Using two systems on the same drilling platform involves the changing of one system to another system which costs time and consequently is an economic disadvantage.

The normal drilling process uses fixed lengths of drill pipe such as range III (45 feet) or range II (30 feet) lengths. Drilling a well involves drilling a length of drill pipe disconnection of the top drive, hoisting the top drive, connection of a new length of drill pipe and drilling the well. Handling the drill pipe on the drill floor is dangerous and a lot of accidents happen of with fatal consequences. When the drilling is completed fixed lengths of casing are lowered into the bore hole using the same method as is being used during drilling. Assembling the desired total lengths of casing using fixed lengths of casing tubulars takes a long time. Connecting the tubulars is equally dangerous compared to the handling of drill pipe. Another disadvantage is that the connection failures between the casing are a main reason for problems occurring during the placement of the casing. This is especially the case when expandable casing is used. It has long been needed to have a drilling method and a method for lowering casing which does not involve separate lengths of tubulars being connected to each other.

An object of the invention is to provide multipurpose reeled tubing assembly, which can run at higher casing running speeds, of a factor of 3 to 5 times faster than conventional running speeds.

Another object of the invention is to eliminate having to use connections with casing prior to running the casing in the riser.

An object of the invention is to increase safety on a rig by eliminating the need for manned operation for making up the casing connection on the drill floor deck, so that safety on the rig is improved. No loose tubulars are on the rig with this process.

During drilling a well a critical parameter is controlling the well at all costs a blow out is to be prevented. Apart from safety issues ultimate well productivity depends strongly on the damage the formation sustained during drilling. Using separate lengths of drill pipe and/or casing requires a discontinue mud flow. Precise control of the mud pressure is not possible. It is highly desired to have a method that can continuously control the well pressure with high accuracy during the drilling and casing installing process.

An object of the invention is to provide a method for flowing fluids into the casing at the same time the casing is run into the riser using a continuous flow process.

Another object of this invention is to provide a simple, relatively inexpensive apparatus and method of installing casing, tubing, telemetrics, cabling and survey cabling through the risers into subsea wells.

During the drilling process there is continuously the need for measuring the properties of the ground where the drilling takes place to determine the optimal well trajectory. Using drilling systems according to prior art some vital measurements could only take place after removal of the drill bit. This involves pulling the complete length of drill pipe which can take considerable time. During the installation of casing no measurements can be made. Also specialized equipment is used which must be installed for each measuring job requiring the mud flow to be stopped. This takes valuable time and is often the reason of formation damage. The possibility to take measurements on a continuous basis while maintaining full well control has long been needed.

An object of the invention is to install into the casing telemetrics and survey equipment for a bore hole in a continuous flow process, so that continuous measurement of the well can occur without a break in the measuring or analysis process.

A know problem during the use of expandable casing is the lowering of the expandable casing in the well bore. In most cases several trips down hole are needed to place expandable casing. This is undesirable due to the time loss and the decreased well control.

An object of the invention is to develop equipment so that when using expandable casing so that two tubulars can be run simultaneously, one inside the other at the same time avoiding the need for additional trips.

An object of the invention is to be able to run two casing lines simultaneously in a continuous flow process.

Another object is to provide for using a reeled assembly to install tubing through subsea risers into subsea wells in a continuous flow manner.

Another object is to provide for using a moveable continuous method for inserting a plurality of tubing or casings through risers into subsea wells simultaneously.

Other objects features and advantages of this invention will be apparent from the drawings, specification and claims.

In the drawings, wherein like numerals indicate like parts and wherein an illustrative embodiment of this invention is shown:

SUMMARY OF THE INVENTION

The invention contemplates a multipurpose system for reeling tubing to a riser comprising: a reel containing tubing driven by a reel drive; a guide for receiving tubing and bending the tubing forming bent tubing; a straightener for receiving bent tubing and forming straightened tubing; a support frame attached to tower using a rotating connection for supporting the guide and a straightener; a tower or other supporting structure for suspending the straightener, guide and a support frame over a deck; a tensioner for receiving straightened tubing, attached to a tensioner frame, supporting the straightened tubing and lowering the straightened tubing into a riser; a tensioner frame for supporting the tensioner; and a reel support frame for supporting the reel.

BRIEF DESCRIPTION OF THE DRAWINGS

A specific embodiment of the invention will be described by way of example with reference to the accompanying drawings, in which.

DETAILED DESCRIPTION OF THE PREFERRED EMBODIMENTS

In accordance with this invention the reeled tubing assembly is used on a drilling rig or production rig having a tower or other supporting structure. It should be noted that the reeled tubing assembly can be used on a drilling vessel having a moon pool and tower or structure as well, and it can be used on semisubmersible tenders used in association with drilling ships and rigs.

Figure 1:
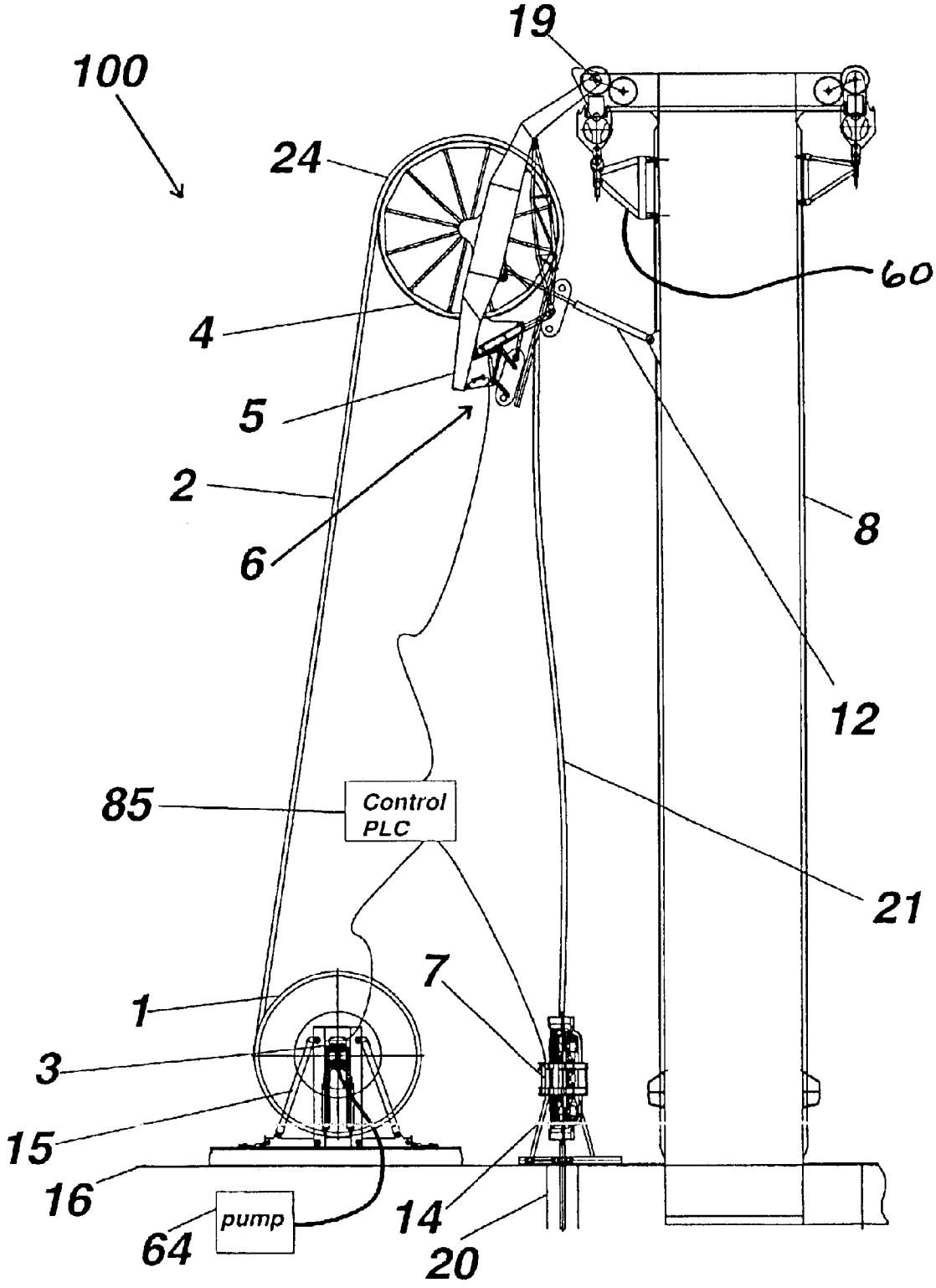
FIG. 1 is a side illustration of the multipurpose system of the invention on a platform.

As shown in FIG. 1, the multipurpose system 100 has a reel 1 for moving tubing 2 which can be casing, expandable casing or another tubular. These tubulars can be run down a riser for a subsea well. The reel 1 maintains the tubing 2 in tension.

Tubing 2 runs from reel 1 to guide 4 which preferably is a wheel structure. Guide 4 is for aligning the tubing 2 and guiding the tubing 2 to the straightener 6. The reel 1 is preferably mounted on a reel support frame 15. In the most preferred embodiment it is removeably secured to the reel support frame. In addition, the reel support frame 15 is removably secured to a platform 16.

In the preferred embodiment, a reel drive 3 powers the reel 1 and is secured to the reel support frame 15. The reel drive 3 rotates the reel 1.

In the most preferred embodiment, reel support frame 15 is moveable and can be skid mounted to platform 16. The reel drive 3 is removeably connected to the reel 1 and the reel support frame 15. It is possible that when all tubing has been run from the reel, the empty reel is replaced by another reel which has been preloaded with tubing, or casing, or expandable casing or a similar tubular.

Guide 4 is distanced apart from reel 1, and is secured to the upper portions of a tower 8, which is secured to the platform, which can be a tension leg platform, a fixed leg platform, a ship, a barge, a jack up, a semisubmersible or another drilling vessel.

Tower 8 can be a multipurpose drilling tower, such as one made by Huisman Special Lifting Equipment BV.™ of the Netherlands. The tower 8 could be derrick. The tower 8 is contemplated in the most preferred embodiment to suspend the straightener 6 and the guide 4. In addition, a support frame 5 for supporting the guide and the straightener is attached to the tower 8.

The support frame 5 is held in a spaced apart relationship from the tower 8, preferably using hydraulic cylinder 12. The support frame 5 is preferably supported above the platform 16.

Tubing 2 is passed around the guide and to straightener 6, which is a conventional tubing straightener for bending pipe as is well known in the art. Straightener 6 is also attached to support frame 5 on the tower. The support frame can be hollow, made from solid plate or made from segmented plate. Tubing 2 can have a nominal diameter of between 3.5 and 20 inches. In a preferred embodiment the nominal diameter is 12 inches. The rotating connection 19 is disposed between the lower 8 and the support frame enabling the support frame to rotate out of the firing line of the tower 8.

In the preferred embodiment, support frame 5 is attached to tower 8 using a rotating connection 19, however, it is contemplated that other types of connections can be used such as connection to the motion-compensated trolley 60.

To facilitate maintenance and installation support frame 5 can be disconnected from the tower and lowered to the platform so no extra equipment is needed for this maintenance function.

Tubing 2 from the guide 4 is noted as bent tubing 24 and tubing that has passed through the straightener 6 is noted as straightened tubing 21.

In one embodiment, it is contemplated that hydraulic cylinders 12 are attached to the tower 8 and used to move the support frame 5 out of the firing line or into the firing line for normal drilling activities without interference with the multi-purpose system. It is possible for the hoist 60 to pass between the support frame 5 and the tower 8 when the support frame 5 is moved out of the firing line.

Straightened tubing 21 flows to a tensioner 7, which is supported on a tensioner frame 14 for supporting the tensioner. Tensioner 7 is for receiving the straightened tubing 21 and passing the straightened tubing to a riser 20. Tensioner frame 14 is preferably removably connected to the platform, such as the deck of a drilling vessel, and is used to move the tensioner to avoid interference during the normal drilling process. The tensioner 7 is secured to the tensioner frame for receiving the straightened tubing supporting the straightened tubing and moving the straightened tubing.

A pump 64 connected to the reel 1 can be used to pump fluids, such as gas or other media into or through the tubing. Fluids can be any conventional type, and can include optically transparent fluids and/or acoustically homogenous fluids and combinations thereof.

A computer 85 can be used to control the reel drive 3 and tensioner. The computer can be used in connection with the reel, straightener and the tensioner to monitor and operate the speed and tension at which the tubing passes into the riser. It is contemplated that the system will operate at a rate between 1 and 10,000 feet of tubing per hour but preferably the system will run at a speed between 5000 and 7000 feet of tubing per hour.

It is contemplated that the reel support frame and the tensioner frame are moveable frames. They can be moveable with push pull units, skid mounted or on wheels.

Figure 2:
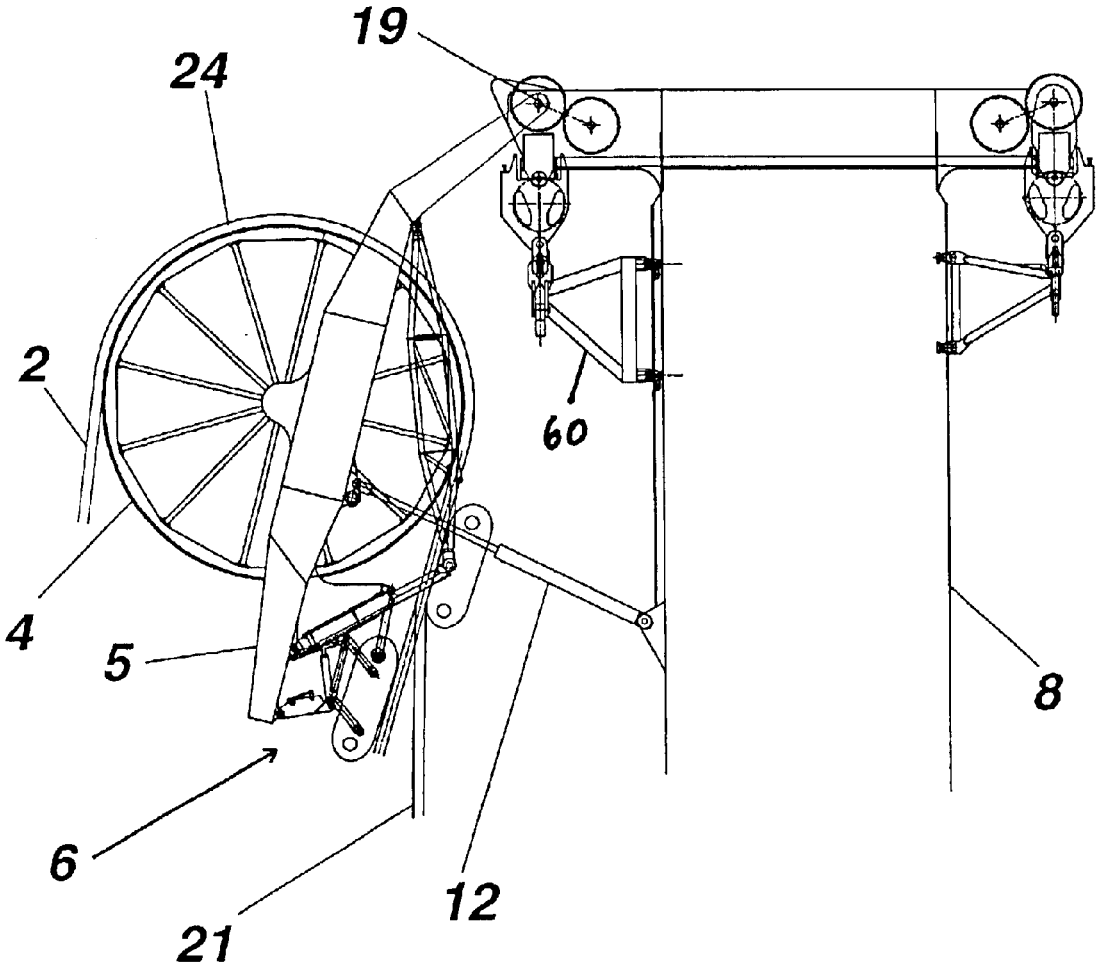
FIG. 2 is a detail of FIG. 1 showing the guide for aligning the tubing and the straightener and support frame.

FIG. 2 shows a detail of the guide 4 as tubing 2 passes over guide 4. Support frame 5 is shown secured to tower 8 which can be a drilling tower or lifting tower at rotating connection 19. A heave or motion-compensator can be connected to the support frame and used to balance the multipurpose system. A hydraulic cylinder 12 is shown attached to the support frame 5 for maintaining the support frame in a spaced relation from the tower. The straightener 6 is shown in more detail as having the conventional three-part straightener construction. Bent tubing 24 is formed by guide 4 passed to straightener 6, which straightens the tubing forming straightened tubing 21.

Figure 3:
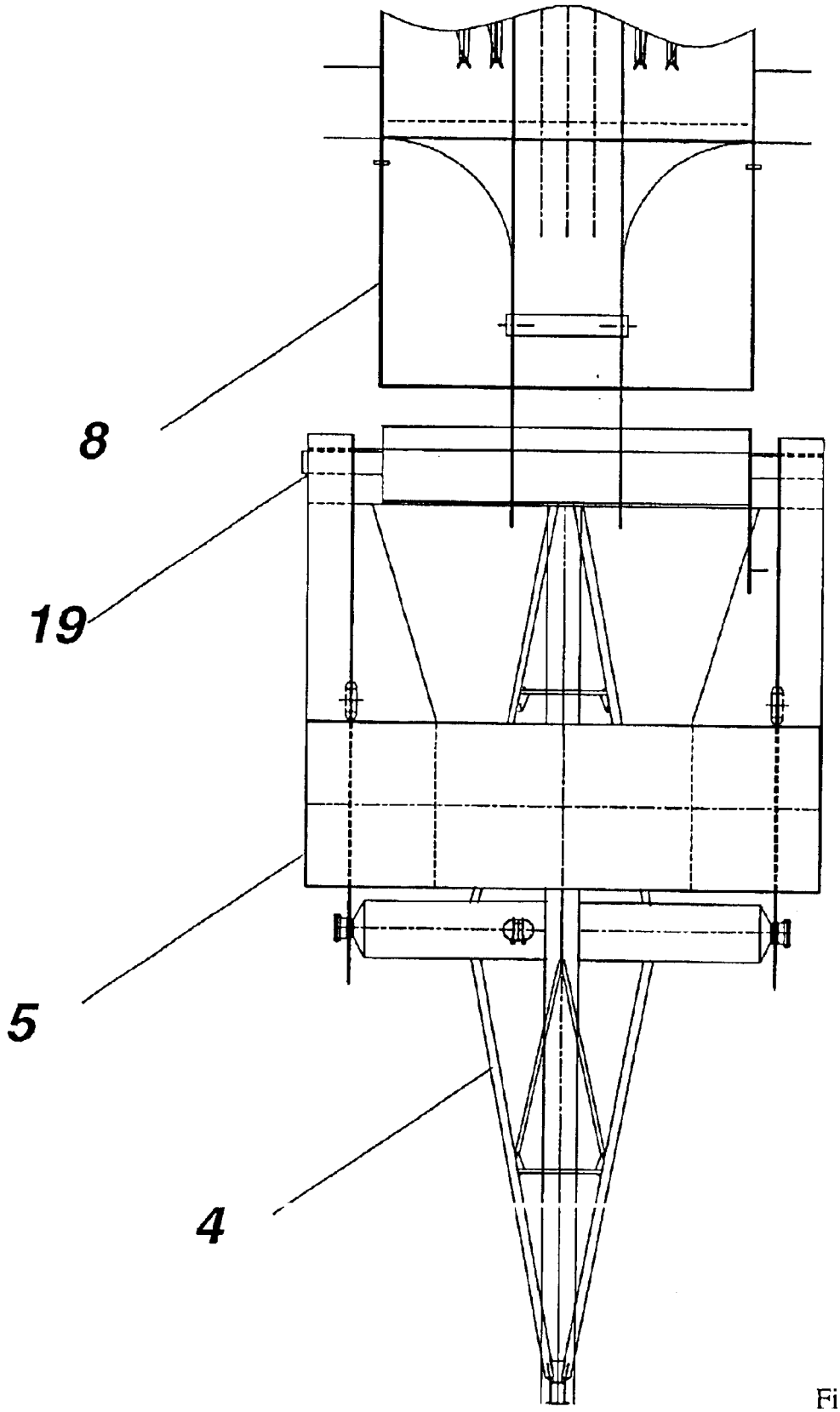
FIG. 3 is a plan view of FIG. 1.

FIG. 3 shows a plan view of the invention showing how the guide 4 with support frame 5 is secured to the tower 8 in a preferred embodiment, using movable, rotating connection 19.

Figure 4:
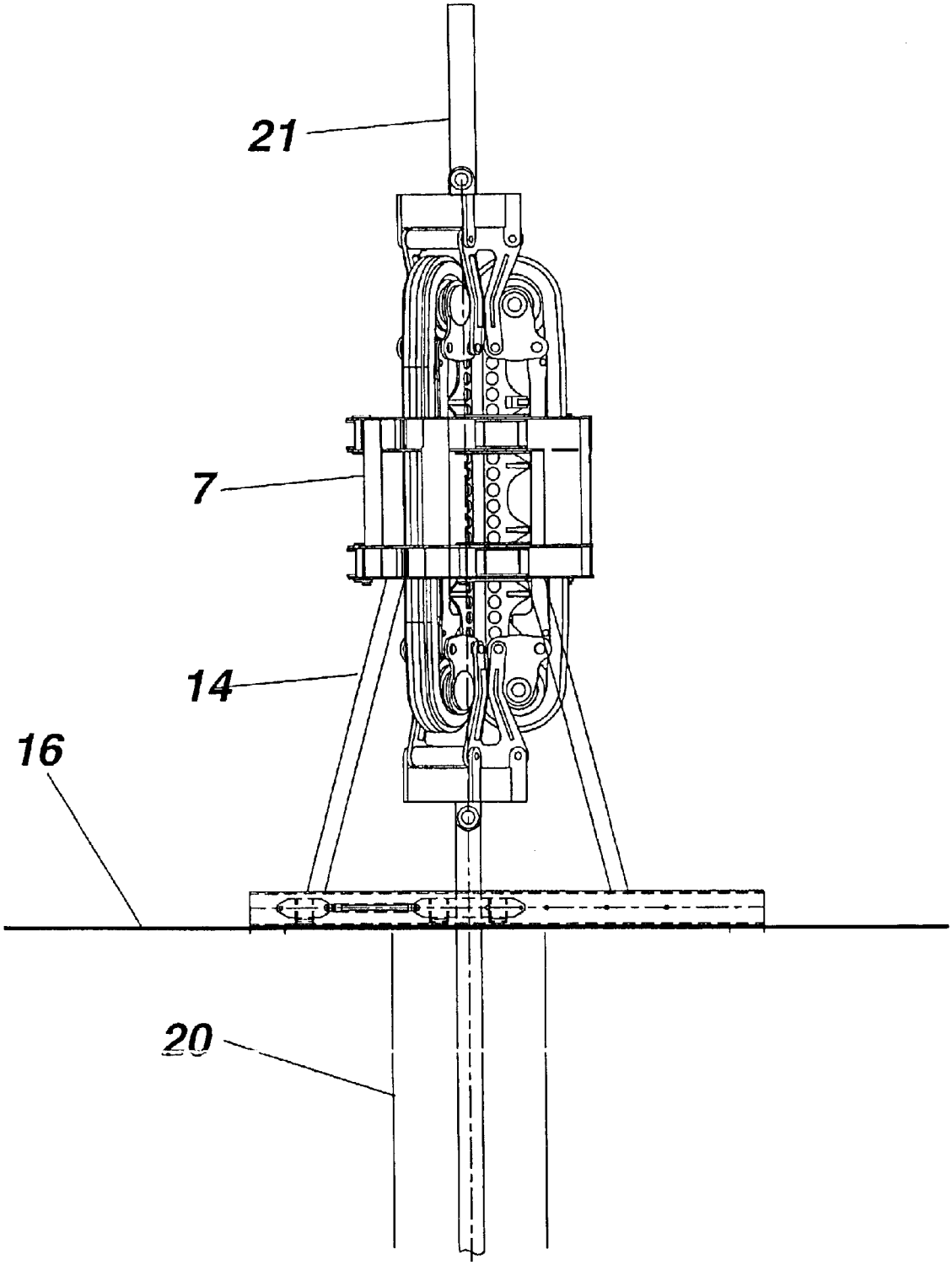
FIG. 4 is a side view of a tensioner on a support frame according to the invention.

FIG. 4 is a side view of the tensioner 7 of the invention secured to the tensioner frame 14, which is preferably a skid mounted unit, or a unit mounted on rails or having some other moveable feature to slide the tensioner frame 14 along platform 16. In this FIG. 4, straightened tubing 21 is shown entering the tensioner and tubing is shown exiting the tensioner and entering the riser 20.

To use the device, the tubing is first positioned on the reel 1. Reel 1 is fixed to the reel support frame 15, which is then latched to the platform or otherwise maintained in position on the platform.

The tubing is fed from the reel while the reel maintains the tubing in tension. A line is brought over the tensioner to the reel drive. The line picks up the tubing or casing over the guide through the straightener into the tensioner and the system is ready to operate.

When necessary, the tensioner skids forward to the well center, the guide and supporting frame are rotated into the well center.

At the well center, casing can be reeled into the riser, when all casing has been run into the riser, the casing can be fixed to the drill floor deck, and the tensioner can be skid back, and the casing can be run further down the hole using normal drill pipe or using a coiled tubing unit.

The casing used in the invention can be prepared off line without interfering with the normal drilling process.

When multiple reels are used, the casing is welded under the tensioner above the tensioner support frame or welding or connecting can be done above the tensioner. Tubing can be welded together after the straightened tubing passes the tensioner. Alternatively, the tubing can be mechanically connected together after the straightened tubing passes the tensioner.

The tubing from the tensioner is guided to the riser in any desired manner.

It is contemplated that the entire assembly can be operated with tubing or casing connected together in a continuous flow method.

A further embodiment of the invention contemplates that various types of lines, or cabling, such as communications lines or cable can be flowed into the tubing at the same time the tubing flows into the riser, enabling a multipurpose feature to the assembly and related method of use. The types of links which are envisioned as being used at the same time the casing or tubing is run into the riser include links and cable for telemetry, surveying, power and communications. Even fiber optic lines can be run into the riser simultaneous with the tubing using this multipurpose reeled tubing assembly.

Alternative embodiments contemplates that the support frame is hollow or made from segmented plates. It is also contemplated that the support frame is connected to a heave compensation system.

The tubing contemplated for this invention is contemplated to have a diameter between 3.5 and 20 inches. In the most preferred embodiment, the tubing is casing and it is reeled into a riser.

It is noted that this invention, because of having a continuous flow of tubing, gives the added advantage to prevent loss of environmentally objectionable fluids into the sea. In addition, it should save human lives and damaging accidents, because humans are no longer needed to run the casing for as much time on the deck.

The foregoing disclosure and description of the invention are illustrative and explanatory thereof and various changes in the method and system and in the size, shape and materials, as well as in the details of the illustrated construction, may be made within the scope of the claims without departing from the spirit of the invention.

What is claimed is:

1. A multipurpose system for reeling tubing secured to the subsea platform or the floating vessel, comprising:

a. a reel support frame removeably secured to a subsea platform or the floating vessel;

b. a reel containing tubing, wherein the reel is removeably secured to the reel support frame;

c. a reel drive for rotating the reel disposed on the reel support frame;

d. a tower for suspending a straightener and a guide;

e. a support frame held in a spaced apart relationship to the tower and attached to the tower;

f. a guide disposed on the support frame for receiving tubing from the reel and ending the tubing forming bent tubing;

g. a straightener disposed on the support frame for receiving the bent tubing and forming straightened tubing;

h. a rotating connection for connecting the support frame to the tower and moving the support frame out of a firing line of the tower or into the firing line of the tower;

i. a tensioner frame removeably mounted on the subsea platform or floating vessel; and j. a tensioner secured to the tensioner frame for receiving the straightened tubing, supporting the straightened tubing and moving the straightened tubing.

2. The system of claim 1, further comprising a plurality of reels each containing tubing, wherein the tubing from each reel is welded together after the straightened tubing passes the tensioner.

3. The system of claim 1, further comprising a plurality of reels each containing tubing, wherein the tubing from each reel is mechanically connected after the straightened tubing passes the tensioner.

4. The system of claim 1, wherein the tubing is casing.

5. The system of claim 4, wherein the casing is expandable casing.

6. The system of claim 1, further comprising a hydraulic cylinder attached to the support frame for maintaining the support frame in a spaced relation from the tower.

7. The system of claim 1, wherein the support frame is rotatable.

8. The system of claim 1, wherein the guide is a wheel.

9. The system of claim 1, wherein the support frame is hollow.

10. The system of claim 1, wherein the support frame is segmented plate.

11. The system of claim 1, wherein the tensioner frame or the reel support frame is moveable using a push pull unit.

12. The system of claim 1, wherein the reel support frame is skid mounted or wheel mounted.

13. The system of claim 1, wherein the tensioner frame of is skid mounted or wheel mounted.

14. The system of claim 1, wherein the system comprises a computer connected to the reel, the straightener and the tensioner for monitoring and operating the speed and tension at which the tubing passes the tensioner.

15. The system of claim 1, wherein the tubing moves at a rate between 1 foot per hour and 10,000 feet per hour.

16. The system of claim 15, wherein the tubing moves at a rate between 5000 feet per hour and 7000 feet per hour.

17. The system of claim 1, wherein the system further comprises a member of the group consisting of communication lines, telemetry lines, fiber optic cables, and power lines disposed within the tubing.

18. The system of claim 1, wherein the tubing has a diameter between 3.5 inches and 20 inches.

19. The system of claim 1, wherein the tubing is reeled into a riser.

20. A multipurpose system for reeling tubing secured to a platform, comprising:

a. a reel support frame removeably secured to a platform;

b. a reel containing tubing removeably secured to the reel support frame;

c. a reel drive for rotating the reel disposed on the reel support frame;

d. a pump connected to the reel for pumping fluid through the tubing, wherein the pump supplies pressurized optically transparent fluid, acoustically homogenous fluid or combinations thereof to the tubing;

e. a tower for suspending the straightener and the guide;

f. a support frame attached to the tower;

g. a guide disposed on the support frame for receiving tubing from the reel and ending the tubing forming bent tubing;

h. a straightener disposed on the support frame for receiving the bent tubing and forming straightened tubing;

i. a rotating connection for connecting the support frame to the tower;

j. a tensioner fame removeably mounted on the platform; and k. a tensioner secured to the tensioner frame for receiving the straightened tubing, supporting the straightened tubing and moving the straightened tubing.

* * * * *